US006600465B1

(12) United States Patent
Koyama

(10) Patent No.: US 6,600,465 B1
(45) Date of Patent: Jul. 29, 2003

(54) DRIVER CIRCUIT FOR ACTIVE MATRIX DISPLAY

(75) Inventor: Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 09/311,157

(22) Filed: May 13, 1999

Related U.S. Application Data

(63) Continuation of application No. 08/557,345, filed on Nov. 14, 1995, now Pat. No. 6,023,257.

(30) Foreign Application Priority Data

Dec. 22, 1994 (JP) ..... 6-336424

(51) Int. Cl.[7] ..... G09G 3/36
(52) U.S. Cl. ..... 345/87; 345/89; 345/904
(58) Field of Search ..... 345/87, 89, 99, 345/904

(56) References Cited

U.S. PATENT DOCUMENTS 5,041,823 A * 8/1991 Johnson et al. ..... 340/784
5,206,633 A * 4/1993 Zalph ..... 340/784
5,625,373 A * 4/1997 Johnson ..... 345/58
5,793,344 A 8/1998 Koyama ..... 345/87

FOREIGN PATENT DOCUMENTS

JP 2-061698 3/1990

OTHER PUBLICATIONS

English abstract re Japanese patent application No. JP 2–061698 published Mar. 1, 1990.

* cited by examiner

*Primary Examiner*—Matthew Luu
(74) *Attorney, Agent, or Firm*—Cook, Alex, McFarron, Manzo, Cummings & Mehler, Ltd.

(57) ABSTRACT

A driver circuit for driving an active matrix liquid crystal display without producing flicker. The inversion frequency of the voltage applied to the liquid crystal panel of the display is examined, the frequency being intrinsic to the display. The difference between voltages applied to opposite sides of the liquid crystal panel is found from the transmissivity of the liquid crystal material, by making use of an image sensor. The found value is converted into digital form by an analog-to-digital converter and stored in a correcting value storage device. When the active matrix display is in use, the difference signal which is found for each pixel and stored in the storage device is added to an image signal applied to the active matrix display, thus preventing flicker intrinsic to the liquid crystal panel.

42 Claims, 3 Drawing Sheets

DRIVER CIRCUIT FOR ACTIVE MATRIX DISPLAY

This application is a continuation of the U.S. application Ser. No. 08/557,345 filed Nov. 14, 1995, now U.S. Pat. No. 6,023,257.

BACKGROUND OF THE INVENTION

1. Field of the Invention

The present invention relates to a driver circuit for an active matrix display and, more particularly, to reductions in electric power consumed by the active matrix display.

2. Description of the Related Art

An active matrix display has pixels disposed at intersections. Each pixel is provided with a switching device. Information about an image is controlled by turning on and off each switching device. A liquid crystal material is used as a display medium in such a display device. In the present invention, a thin-film transistor (TFT) having three terminals (i.e., gate, source, and drain) is used as each switching device.

In the present specification, rows of a matrix construction signify signal lines (gate lines) extending parallel to the rows and connected with the gate electrodes of transistors in the rows. Columns signify signal lines (source lines) extending parallel to the columns and connected with source (or drain) electrodes of transistors in the columns. A circuit for activating the gate lines is referred to herein as a gate driver circuit. Also, a circuit for activating the source lines is referred to herein as a source driver circuit. Furthermore, thin-film transistors are often referred to herein as TFTs.

In the gate driver circuit, the same number of shift registers as gate lines arranged in the vertical direction are connected in a line and in series, to produce vertical scanning timing signals for an active matrix display. In this way, the gate driver circuit turns on and off each TFT inside the active matrix display.

In the source driver circuit, the same number of shift registers as source lines arranged in the horizontal direction are connected in a line and in series, to provide a display of the horizontal components of image data to be displayed on the active matrix display. The analog switches are turned on and off by latch pulses synchronized with the horizontal scanning signal. In this manner, the source driver circuit selectively activates the TFTs inside the active matrix display and controls the orientation of each pixel cell.

Signals applied to the prior art active matrix display are shown in FIG. 3. These signals applied to the active matrix display assume analog form. One frame of image is composed of two fields. A phase conversion is made every field.

In FIG. 3, the voltage Vs of the image signal and a voltage V1 applied to the common electrode are shown. Since the voltage Vs is applied to the electrode at each pixel, a differential voltage Vs−V1 is applied across the pixel cell positioned between the electrode and common electrode. The phase of the voltage Vs is inverted every field, and as a result the voltage applied to each pixel cell is a substantially symmetrical AC voltage. In this way, the DC voltage remaining on each pixel cell is reduced. This prolongs its lifetime.

The electric power consumed by the active matrix display can be reduced effectively by lowering the frequency at which the applied voltage is inverted.

However, as the period of the inversion of the phase of the voltage applied to the active matrix display is increased, an electric charge is drawn into each TFT has a capacitive component. As a result, a voltage difference is produced between the voltage of the analog image signal applied to the active matrix display and the voltage applied to the common electrode, the difference corresponds. The drawn electric charge, and causes a flicker.

Further, each individual active matrix liquid crystal display has different characteristics. Where deterioration of the used liquid crystal material is taken into account, it is impossible to reduce the inversion frequency of the applied voltage by the same amount for every display device. Accordingly there is a need for a simple method of adjusting the inversion frequency of the applied voltage according to the characteristics of each individual active matrix display.

SUMMARY OF THE INVENTION

It is an object of the present invention to provide a driver circuit for use with an active matrix display and which is capable of adjusting the inversion frequency of a voltage applied to the active matrix display according to the characteristics of this active matrix display.

One embodiment of the present invention for achieving the above object is as follows.

When an active matrix display is being inspected, the inversion frequency of the applied voltage, which is intrinsic to this liquid crystal panel and at which a flicker is produced, is examined. Then, a voltage, which is actually applied to the liquid crystal panel, is detected from the transmissivity of the liquid crystal. This voltage can be detected, for example, by using a image sensor. Then, a differential voltage between the applied voltage and the actually applied voltage is stored in a memory.

In normal use, the differential voltage is read out, added into an image signal, and applied to each pixel.

At this time, the actually applied voltage is the difference between the voltages applied to the opposite sides of the liquid crystal panel, which is found from the transmissivity of the liquid crystal material for each pixel. The found voltage is converted into digital form by an A/D converter. Data about the obtained digital values is stored in the memory.

As mentioned above, when the active matrix display is in use, an image signal-correcting circuit adds the differential signal for each pixel to the image signal, the differential signal having been stored in the memory. This the prevents the flicker intrinsic to the liquid crystal panel. As a result, the inversion frequency of the analog image signal can be reduced, which contributes to a reduction in electric power consumed by the active matrix display.

Other objects and features of the present invention will appear in the course of the description thereof, which follows.

DETAILED DESCRIPTION OF THE PREFERRED EMBODIMENTS

EXAMPLE 1

Figure 1:
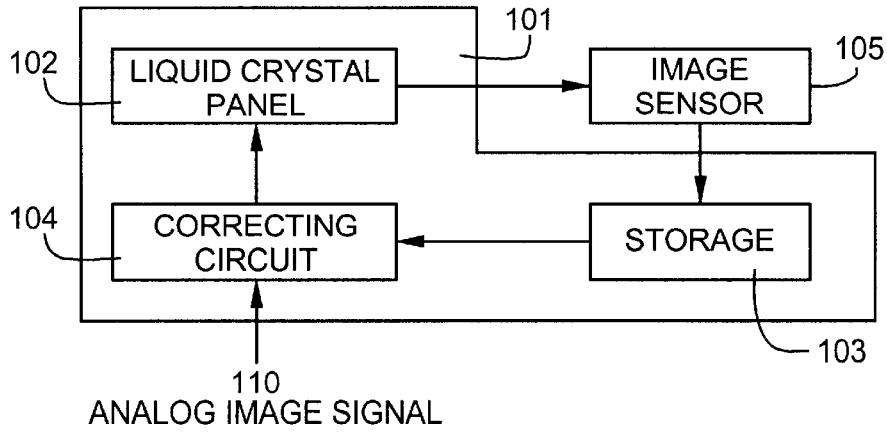
FIG. 1 is a block diagram of an active matrix display according to the present invention.

The structure of the present example is shown in FIG. 1. An active matrix display 101 has a liquid crystal panel 102, a correcting value storage device 103, and an analog image signal-correcting circuit 104. An image sensor 105 forms a testing jig for the active matrix display 101 and is interfaced with the correcting value storage device 103 of the active matrix display 101.

Figure 4:
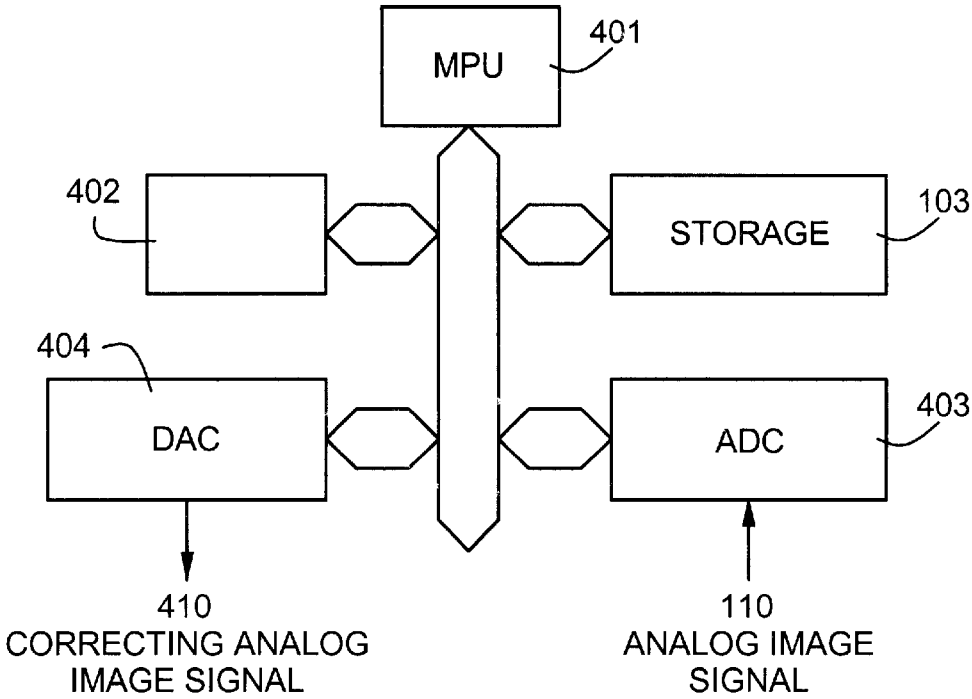
FIG. 4 is a block diagram of the analog image signal-correcting circuit incorporated in the active matrix display shown in FIG. 1.

The correcting value storage device 103 can include an EPROM (erasable programmable read-only memory), PROM (programmable read-only memory), SRAM (static random-access memory) backed up by a battery, flash memory, hard disk drive, or the like. The analog image signal-correcting circuit 104 has a MPU (microprocessing unit) 401, a ROM (read-only memory) 402, an analog-to-digital converter (ADC) 403, and a digital-to-analog converter (DAC) 404, as shown in FIG. 4. The image sensor 105 includes photodiodes and CCDs (charge-coupled devices).

This active matrix display 101 operates in the manner described below. When the active matrix display 101 is inspected, the testing jig is first connected to the active matrix display 101. An analog image signal 110 is then applied to the active matrix display 101. At this time, the correcting function of the analog image signal 110-correcting circuit 104 is disabled. Under this condition, the analog image signal 110 is entered into the liquid crystal panel 102 as it is. Then, the frequency of the analog image signal is varied to find the frequency at which a flicker occurs. The transmissivity of the liquid crystal panel 102 at each pixel is accepted into the image sensor 105. Electric charge corresponding to the transmissivity recognized by the image sensor 105 is converted into digital form and held in the correcting value storage device 103.

Figure 5:
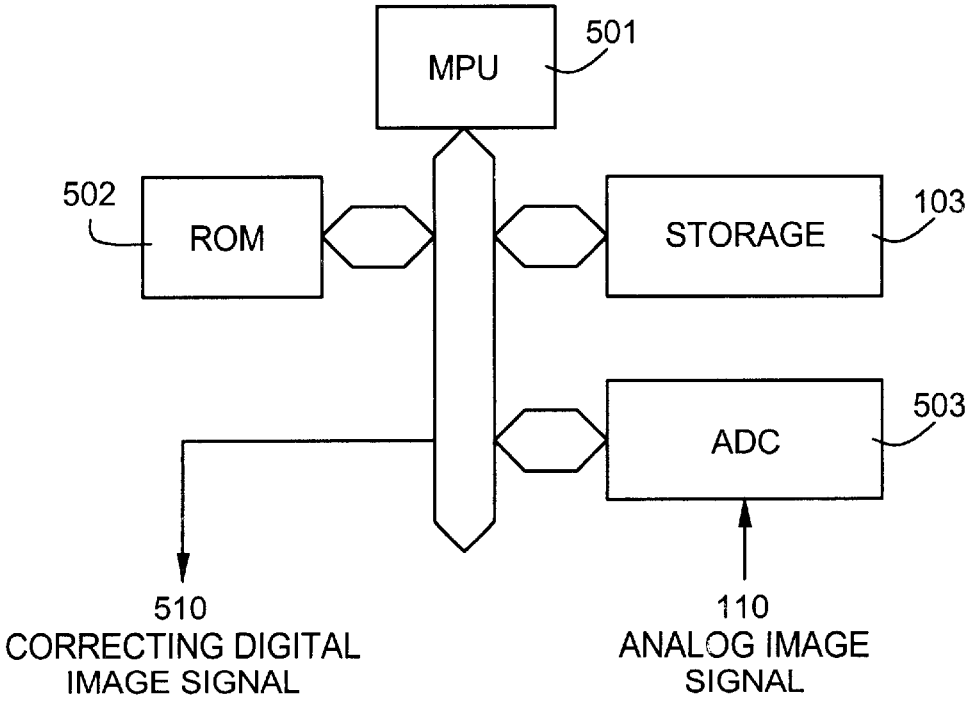
FIG. 5 is another block diagram of the analog image signal-correcting circuit incorporated in the active matrix display shown in FIG. 1.

When the active matrix display 101 is used in a normal manner, the analog image signal 110 is converted into digital form by the A/D converter (ADC) 403. The MPU 401 reads the corresponding value in the correcting value storage device 103. This read value is added to the digital image signal, thus creating a correcting digital image signal. This correcting digital image signal is converted into a correcting analog image signal 410 by the D/A converter 404 and supplied to the liquid crystal panel 102. Alternatively, a circuit such as that shown in FIG. 5 can be used. When the active matrix display 101 is used in a normal manner, the analog image signal 110 is converted into digital form by the A/D converter (ADC) 503. The MPU 501 reads the corresponding value in the correcting value storage device 103. This read value is added to the digital image signal, thus creating a correcting digital image signal 510. This correcting digital image signal is supplied to the liquid crystal panel 102.

As a result, a flicker, which would normally be caused by a voltage drop due to drawn electric charge when each TFT of the liquid crystal panel 102 is activated, can be prevented. This permits the period of the inversion of the analog image signal to be increased. The maximum period attainable depends on the kind of the liquid crystal material used. For example, with fluorine liquid crystal material ZLI-4792 (produced by Merck), the period can be increased up to 100 times the period of the vertical synchronizing signal in order to reduce a consumption of electric power.

EXAMPLE 2

Figure 2:
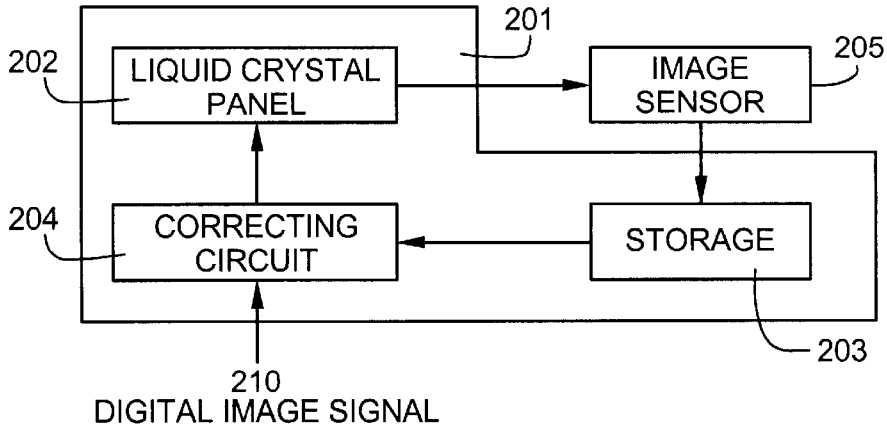
FIG. 2 is a block diagram of another active matrix display according to the present invention.
Figure 3:
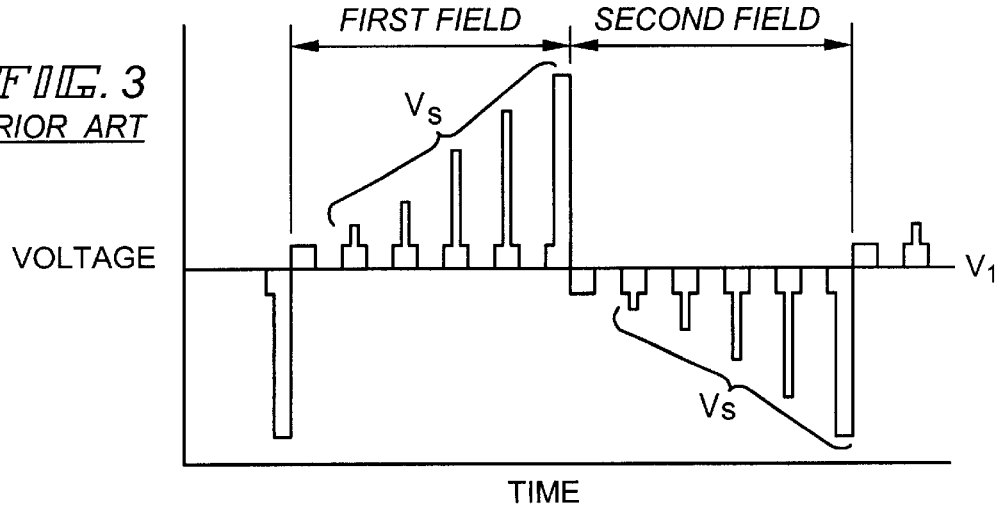
FIG. 3 PRIOR ART
FIG. 3 is a waveform diagram illustrating various voltages applied to the prior art active matrix display.

The structure of the present example is shown in FIG. 2. An active matrix display 201 has a liquid crystal panel 202, a correcting value storage device 203, and a digital image signal-correcting circuit 204. An image sensor 205 forms a testing jig for the active matrix display 201 and is interfaced with the correcting value storage device 203 of the active matrix display 201.

Figure 6:
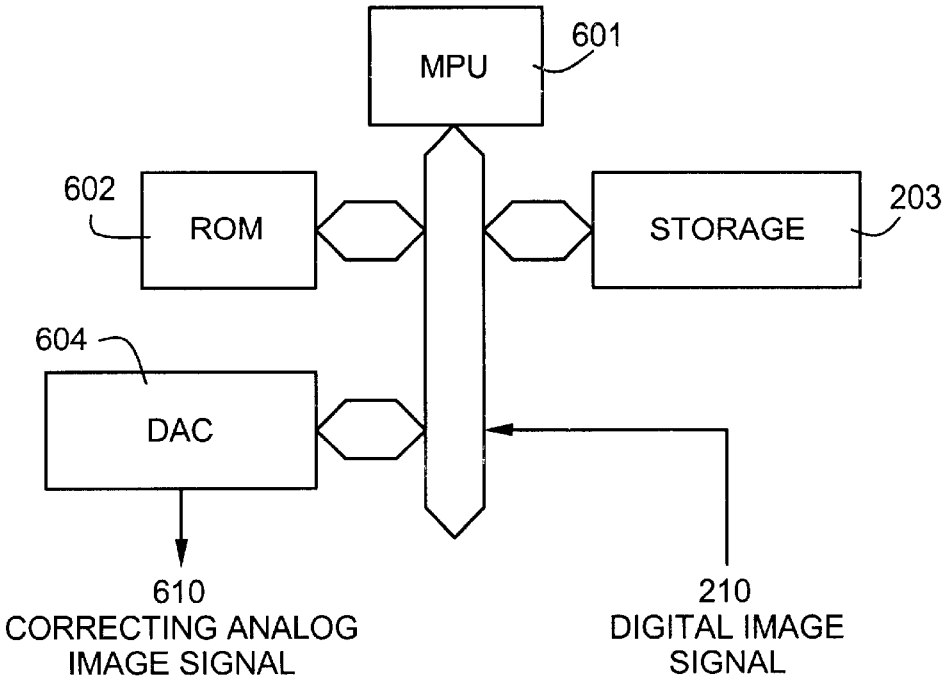
FIG. 6 is a block diagram of the digital image signal-correcting circuit incorporated in the active matrix display shown in FIG. 2.

The correcting value storage device 203 can include an EPROM (erasable programmable read-only memory), PROM (programmable read-only memory), SRAM (static random-access memory) backed up by a battery, flash memory, hard disk drive, or the like. The digital image signal-correcting circuit 204 has a MPU (microprocessing unit) 601, a ROM (read-only memory) 602, and a digital-to-analog converter (DAC) 604, as shown in FIG. 6. The image sensor 205 includes photodiodes and CCDs (charge-coupled device).

This active matrix display 201 operates in the manner described below. When the active matrix display 201 is inspected, the testing jig is first connected to the active matrix display 201. A digital image signal 210 is then applied to the active matrix display 201. At this time, the correcting function of the digital image signal-correcting circuit 204 is disabled. Under this condition, the digital image signal 210 is applied to the liquid crystal panel 202 as is. Then, the frequency of the digital image signal 210 is varied to find the frequency at which flicker occurs. The transmissivity of the liquid crystal panel 202 at each pixel is accepted into the image sensor 205. Electric charge corresponding to the transmissivity recognized by the image sensor 205 is converted into digital form and held in the correcting value storage device 203.

When the active matrix display 201 is used in a normal manner, the digital image signal 210 is inputted. The MPU 601 reads the corresponding value in the correcting value storage device 203. This read value is added to the digital image signal 210, thus creating a correcting digital image signal. This correcting digital image signal is converted into a correcting analog image signal 610 by the D/A converter 604 and supplied to the liquid crystal panel 202.

Figure 7:
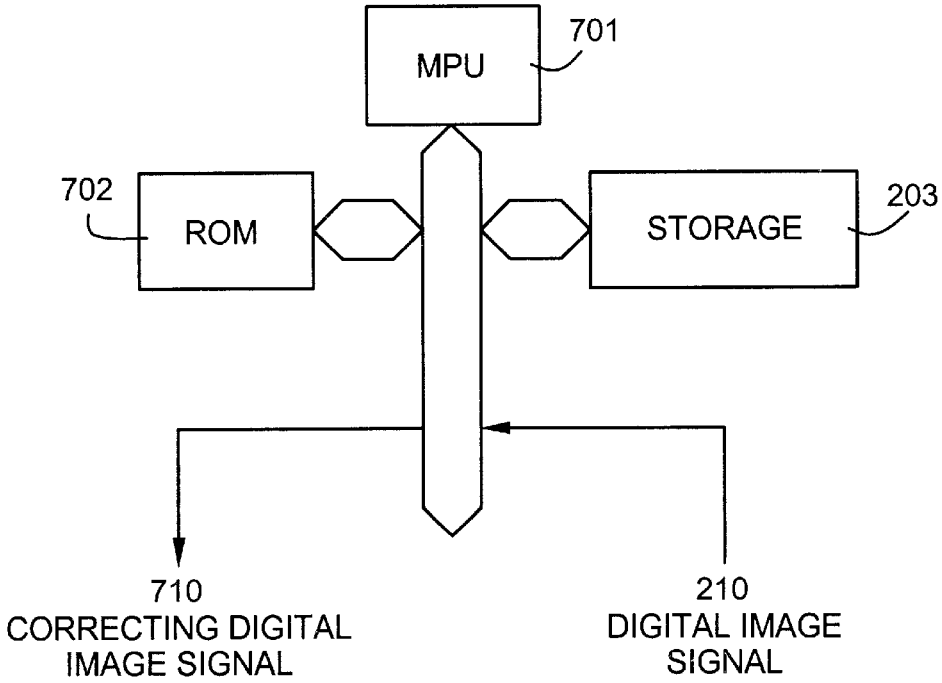
FIG. 7 is another block diagram of the digital image signal-correcting circuit incorporated in the active matrix display shown in FIG. 2.

Alternatively, a circuit such as that shown in FIG. 7 can be used. When the active matrix display 201 is used in a normal manner, the digital image signal 210 is inputted. The MPU 701 reads the corresponding value in the correcting value storage device 203. This read value is added to the digital image signal, thus creating a correcting digital image signal 710. This correcting digital image signal 710 is supplied to the liquid crystal panel 202.

As a result, a flicker, which would normally be caused by a voltage drop due to drawn electric charge when each TFT of the liquid crystal panel 202 is activated, can be prevented. This permits the period of the inversion of the digital image signal to be increased. The maximum period attainable depends on the kind of the liquid crystal material used. For example, fluorine liquid crystal material ZLI-4792 (produced by Merck), the period can be increased up to 100 times the period of the vertical synchronizing signal in order to reduce a consumption of electric power.

In the present invention, an image signal is corrected according to the characteristics of each individual active matrix display. The inversion frequency of the image signal is reduced without impairing the image quality. This can contribute to a decrease in electric power consumed by the active matrix display.

What is claimed is:

1. An active matrix display comprising:

a display panel having pixels;

means for detecting an voltage which is actually applied to said panel when a flicker occurs for each pixel based upon transmissivity thereof in test mode;

means for storing a differential voltage between an applied voltage and said detected voltage;

means for correcting an inputted image signal by adding said differential voltage thereto and supplying said corrected image signal into the corresponding pixel in normal mode.

2. An active matrix display of claim 1 wherein said correcting means is an analog image signal correcting circuit for correcting an inputted analog image signal, comprising an A/D converter for converting said inputted analog image signal into an digital signal and a D/A convertor for outputting said corrected image signal in an analog form.

3. An active matrix display of claim 1 wherein said correcting means is an analog image signal correcting circuit for correcting an inputted analog image signal, comprising an AID converter for converting said inputted analog image signal into an digital signal, and said corrected image signal being output in an digital form.

4. An active matrix display of claim 1 wherein said correcting means is a digital image signal correcting circuit for correcting an inputted digital image signal, comprising a D/A converter for outputting said corrected image signal in an analog form.

5. An active matrix display of claim 1 wherein said correcting means is a digital image signal correcting circuit for correcting an inputted digital image signal, said corrected image signal being output in an digital form.

6. An active matrix display of claim 1 wherein said measuring means comprises an image sensor connected to said panel in said test mode.

7. An active matrix display comprising:

a display panel having pixels;

means for storing a compensating voltage for preventing flicker for each pixel;

means for correcting a image signal based upon said compensating voltage in normal use;

wherein a inversion period of said image signal is increased.

8. An active matrix display of claim 7 wherein said inversion period is set to a value that is more than 100 times as long as the period of a vertical synchronizing signal.

9. A driving method for an active matrix display having pixels, comprising the steps of:

measuring an intrinsic frequency at which a flicker occurs for each pixel by changing frequency of an applied voltage in test mode;

detecting a voltage which is actually applied to said display from transmissivity thereof, said transmissivity corresponding to said intrinsic frequency;

storing a differential voltage between said applied voltage and said actual voltage;

adding said differential voltage into an inputted image signal in normal mode; and supplying said added image signal into the corresponding pixel.

10. The method of claim 9 wherein said differential voltage is stored at digital form and said inputted image signal is an analog signal;

said inputted analog image signal is converted into a digital signal, added said stored differential voltage, converted into an analog signal and outputted.

11. The method of claim 9 wherein said differential voltage is stored at digital form and said inputted image signal is an analog signal;

said inputted analog image signal is converted into a digital signal, added said stored differential voltage, and outputted at a digital form.

12. The method of claim 9 wherein said differential voltage is stored at digital form and said inputted image signal is an digital signal;

said inputted digital image signal is added said stored differential voltage, converted into an analog signal and outputted.

13. The method of claim 9 wherein said differential voltage is stored at digital form and said inputted image signal is an digital signal;

said inputted digital image signal is added said stored differential voltage and outputted at a digital form.

14. A method of claim 9 wherein said transmissivity is detected by an image sensor connected to said display in said test mode.

15. An active matrix display device, which receives an image signal with a polarity that is periodically reversed, comprising:

a display panel having pixels;

a memory to store information about response characteristics of said pixels, wherein said information is obtained by detecting voltages applied to said pixels;

a correction circuit to correct said image signal in accordance with said information; and a driver circuit to apply the corrected image signal to said pixels;

wherein the polarity of the image signal is reversed so infrequently that a flicker in the display panel is prevented.

16. An active matrix display device according to claim 15 further comprising an A/D converter to digitize said image signal before being corrected by said correction circuit.

17. An active matrix display device according to claim 16 further comprising a D/A converter to modify the corrected image data into an analog form.

18. An active matrix display device according to claim 15 further comprising an image sensor for detecting the voltages applied to said pixels.

19. An active matrix display device according to claim 15 wherein the polarity of the image signal is reversed so infrequently that a period for inversion of said signal is 100 times a period of a vertical synchronizing signal.

20. In a method of driving an active matrix display device without a flicker, said device receiving an image signal with a polarity that is periodically reversed and including a display panel having pixels, a memory to store information about response characteristics of said pixels, a correction circuit to correct said image signal in accordance with said information; and a driver circuit to apply the corrected image signal to said pixels; the improvement comprising a step of reversing the polarity of said image signal so infrequently that a flicker in said display panel is prevented.

21. An active matrix display device comprising:

a plurality of pixel electrodes;

a plurality of switching elements for switching said pixel electrodes;

a driver circuit for supplying image signals to said pixel electrodes;

wherein a period of inversion of said image signals is more than 100 times as long as the period of vertical synchronizing signal in order to reduce a consumption of electric power.

22. The active matrix display of claim 21 wherein said switching elements is thin film transistors.

23. The active matrix display of claim 1 wherein said active matrix display is a liquid crystal panel.

24. The active matrix display of claim 7 wherein said active matrix display is a liquid crystal panel.

25. The method of claim 9 wherein said active matrix display is a liquid crystal panel.

26. The active matrix display of claim 15 wherein said active matrix display is a liquid crystal panel.

27. In a method of driving according to claim 20 said active matrix display is a liquid crystal panel.

28. The active matrix display of claim 1 further comprising thin film transistors connected to said pixels.

29. The active matrix display of claim 7 comprising thin film transistors connected to said pixels.

30. The method of claim 9 wherein said active matrix display comprises thin film transistors connected to said pixels.

31. The active matrix display of claim 15 further comprising thin film transistors connected to said pixels.

32. In a method of driving according to claim 20 said active matrix display comprises thin film transistors connected to said pixels.

33. The active matrix display of claim 1 wherein said means for correcting comprises a MP(micro processing unit) and a ROM(read-only memory).

34. The active matrix display of claim 7 wherein said means for correcting comprises a MP(micro processing unit) and a ROM(read-only memory).

35. The method of claim 9 wherein said step of adding uses a MP(micro processing unit) and a ROM(read-only memory).

36. The active matrix display of claim 15 wherein said correction circuit comprises a MP(micro processing unit) and a ROM(read-only memory).

37. In a method of driving according to claim 20 said correction circuit comprises a MP(micro processing unit) and a ROM(read-only memory).

38. The active matrix display device according to claim 1 wherein said means for storing comprises a memory selected from the group consisting of an EPROM(erasable programmable read-only memory), PROM(programmable read-only memory), SAAM(static random-access memory), backed up by a battery, flash memory, hard disk drive.

39. The active matrix display device according to claim 7 wherein said means for storing comprises a memory selected from the group consisting of an EPROM(erasable programmable read-only memory), PROM(programmable read-only memory), SAAM(static random-access memory), backed up by a battery, flash memory, hard disk drive.

40. The method of claim 9 wherein said step of storing uses a memory selected from the group consisting of an EPROM(erasable programmable read-only memory), PROM(programmable read-only memory), SAAM(static random-access memory), backed up by a battery, flash memory, hard disk drive.

41. The active matrix display device according to claim 15 wherein said memory comprises a memory selected from the group consisting of an EPROM(erasable programmable read-only memory), PROM(programmable read-only memory), SAAM(static random-access memory), backed up by a battery, flash memory, hard disk drive.

42. In a method of driving according to claim 20 said memory comprises a memory selected from the group consisting of an EPROM(erasable programmable read-only memory), PROM(programmable read-only memory), SAAM(static random-access memory), backed up by a battery, flash memory, hard disk drive.

* * * * *